US011280115B2

(12) United States Patent
Weber et al.

(10) Patent No.: US 11,280,115 B2
(45) Date of Patent: Mar. 22, 2022

(54) DEVICE FOR MECHANICALLY PREVENTING AUTOMATIC OPENING OF A VEHICLE DOOR AND VEHICLE HAVING SUCH A DEVICE

(71) Applicant: VOLKSWAGEN AKTIENGESELLSCHAFT, Wolfsburg (DE)

(72) Inventors: Stefan Weber, Tappenbeck (DE); Arne Meyer, Tuelau (DE); Sarah Brueggemann, Braunschweig (DE); Dennis Neumann, Ruehen (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 711 days.

(21) Appl. No.: 16/061,687

(22) PCT Filed: Dec. 22, 2016

(86) PCT No.: PCT/EP2016/082458
§ 371 (c)(1),
(2) Date: Jun. 13, 2018

(87) PCT Pub. No.: WO2017/109117
PCT Pub. Date: Jun. 29, 2017

(65) Prior Publication Data

US 2018/0363336 A1 Dec. 20, 2018

(30) Foreign Application Priority Data

Dec. 23, 2015 (DE) ..... 102015226654.0

(51) Int. Cl.
*E05B 77/06* (2014.01)
*E05B 77/04* (2014.01)
*E05B 85/16* (2014.01)

(52) U.S. Cl.
CPC ..... *E05B 77/06* (2013.01); *E05B 77/04* (2013.01); *E05B 85/16* (2013.01)

(58) Field of Classification Search
CPC ..... E05B 77/06; E05B 77/10; E05B 85/10; E05B 77/04; Y10S 292/65; Y10S 292/57; Y10S 292/22
(Continued)

(56) References Cited

U.S. PATENT DOCUMENTS 6,173,535 B1 1/2001 Deischl et al.
8,727,399 B2 * 5/2014 Russell ..... E05B 17/0062 292/216
(Continued)

FOREIGN PATENT DOCUMENTS

DE 19845393 A1 4/2000
DE 102004024288 A1 12/2005
(Continued)

*Primary Examiner* — Kristina R Fulton
*Assistant Examiner* — James Edward Ignaczewski
(74) *Attorney, Agent, or Firm* — Laurence A. Greenberg; Werner H. Stemer; Ralph E. Locher

(57) ABSTRACT

A device for mechanically preventing the automatic opening of a vehicle door in the event of an object acting thereon includes a mounting clip fixed to an outer door part for an outer door handle. The mounting clip has a door opening mechanism having a balancing mass which is adjustably supported on the mounting clip and operatively connected to the outer door handle and can also be moved from a first operating position into a second operating position and back. A force introduction and locking element is associated with the balancing mass. A movement of the balancing mass from the first operating position into the second operating position can be prevented, limited, and/or reversed by way of the element. When viewed in the direction of movement of the bar the force introduction and locking element is advanta-
(Continued)

geously supported against a door lock housing that is fastened to the vehicle door.

8 Claims, 3 Drawing Sheets

(58) Field of Classification Search
USPC ..... 296/146.1, 187.12
See application file for complete search history.

(56) References Cited

U.S. PATENT DOCUMENTS

| | | | | |
|---|---|---|---|---|
| 8,955,257 | B2 * | 2/2015 | Moriya | B60J 5/0425 49/502 |
| 9,567,769 | B2 * | 2/2017 | Zimmer | E05B 77/04 |
| 10,689,887 | B2 * | 6/2020 | Gray | E05B 77/04 |
| 2011/0258935 | A1 * | 10/2011 | Heller | B60J 5/0451 49/502 |
| 2012/0036785 | A1 * | 2/2012 | Bedekar | E05B 77/04 49/394 |

FOREIGN PATENT DOCUMENTS

| | | | |
|---|---|---|---|
| DE | 102005049144 | A1 | 4/2007 |
| DE | 102012020696 | A1 | 5/2013 |

* cited by examiner

DEVICE FOR MECHANICALLY PREVENTING AUTOMATIC OPENING OF A VEHICLE DOOR AND VEHICLE HAVING SUCH A DEVICE

BACKGROUND OF THE INVENTION

Field of the Invention

The invention relates to a device for mechanically preventing the automatic opening of a vehicle door in the event of a barrier acting thereon. The device includes a mounting clip fixed to an outer door part for an outer door handle. The mounting clip has a door opening mechanism having a balancing mass which is adjustably supported on the mounting clip and operatively connected to the outer door handle and can also be moved from a first operating position into a second operating position and back. A force introduction and locking element is associated with the balancing mass and by means of said element, in the event of said barrier acting on the vehicle door as a result of a relative movement between the balancing mass and the force introduction and locking element toward one another and the contact thereof with one another, a movement of the balancing mass from the first operating position into the second operating position can be prevented, limited and/or reversed. The invention further relates to a vehicle, in particular a motor vehicle, having such a device.

Due to legal and consumer test requirements (for example EuroNCAP-MDB-2015, ECE-R95, Korea-NACP) it has to be ensured that in the event of a crash, in particular a side crash, a vehicle door does not open automatically by undefined and/or inadvertent actuation of the external handle and/or a force transmission means thereof, such as a Bowden cable. As a result, in the event of an accident an occupant is prevented from being hurled out of the vehicle. In most cases, the reason for the actuation of the external handle in the side crash cited by way of example is a deformation of the door outer panel. In order to counter these adverse circumstances it is known to support the door outer panel by plate doublers, crash rods or padding which, however, are associated with increased costs, material expenditure and weight. Moreover, a device for mechanically preventing an opening of a motor vehicle door in the event of a side impact by a so-called force introduction element is disclosed in DE 10 2012 020 696 A1, which force introduction element in the event of the penetration of a barrier into the motor vehicle door, for example as a result of a side crash, acts on a Bowden cable lever which is operatively connected to an outer door handle of the motor vehicle door, such that an automatic opening of the motor vehicle door is prevented. Such a Bowden cable lever sometimes also functions as a balancing mass for said outer door handle so that after actuation said handle is automatically returned to its basic position. According to the information in the cited publication, the force introduction element is supported, for example, on a door element such as a door lining, a window or a bodywork edge of the motor vehicle door. From practical experience, however, it is known that such door elements in the event of a side crash do not always maintain their original position and may be deformed into the passenger compartment, resulting in an undefined displacement of said force introduction element toward the vehicle interior. As a result, the reliable function of said force introduction element is not ensured. This is achieved by the invention disclosed hereinafter.

SUMMARY OF THE INVENTION

It is the object of the invention to provide a device for mechanically preventing automatic opening of a vehicle door in the event of a barrier acting thereon, which is further improved relative to the prior art and which by maintaining the advantages of the prior art ensures a reliable function of the device in a particularly simple and advantageous manner. Moreover, it is the object of the invention to provide a vehicle with such a device.

Proceeding from a device for mechanically preventing automatic opening of a vehicle door in the event of a barrier acting thereon, comprising a mounting clip fixed to a door outer part for an outer door handle, which mounting clip has a door opening mechanism having a balancing mass which is adjustably supported on the mounting clip and operatively connected to the outer door handle and can also be moved from a first operating position into a second operating position and back, wherein a force introduction and locking element is associated with the balancing mass and by means of said element, in the event of said barrier acting on the vehicle door as a result of a relative movement between the balancing mass and the force introduction and locking element toward one another and the contact thereof with one another, a movement of the balancing mass from the first operating position into the second operating position can be prevented, limited and/or reversed, the object set forth is achieved in that, when viewed in the direction of movement of the barrier, the force introduction and locking element is supported against a door lock housing fastened to the vehicle door.

By this measure is it advantageously ensured that the force introduction and locking element and the balancing mass come into operative contact as intended in a defined manner and in the shortest time. In other words, the relative movement to be obtained therebetween is utilized to the full. As the force introduction and locking element, viewed in the direction of movement of the barrier, is directly supported on the door lock, a separate movement of the force introduction and locking element is effectively prevented. The door lock housing is arranged and fastened on a front wall of the door shell and, when the vehicle door is closed, is generally positively connected to a closing bolt or closing bracket arranged on the bodywork side by means of a rotary latch. As a result, the door lock housing maintains its original position in a much more effective manner than other preferred door elements according to the prior art.

The subclaims disclose preferred developments or embodiments of the invention.

Accordingly, it is provided that, viewed in the direction of movement of the barrier, the force introduction and locking element is additionally supported against a frame part and/or a door inner part of the vehicle door. As a result, the support of the force introduction and locking element is advantageously increased. A practical embodiment of said force introduction and locking element is formed by a pressure-resistant shaped body. In this case, the shaped body may consist both of plastics and of metal. A shaped body to be produced in a simple and cost-effective manner is formed, in particular, by a foam body which has a low weight whilst ensuring the required functionality. In a development of the invention, the force introduction and locking element is preferably connected by a non-positive and/or material connection to the door lock housing and/or the frame part and/or the door inner part of the vehicle door, resulting in a secure hold thereof on the vehicle door with simple mounting of the force introduction and locking element.

The invention further relates to a vehicle, in particular a motor vehicle, having a device of the type described above.

BRIEF DESCRIPTION OF THE SEVERAL VIEWS OF THE DRAWING

The invention is described in more detail hereinafter with reference to an exemplary embodiment shown schematically in the drawings. However, the invention is not limited thereto but encompasses all of the embodiments defined by the claims. In the drawings:

DESCRIPTION OF THE INVENTION

Figure 1:
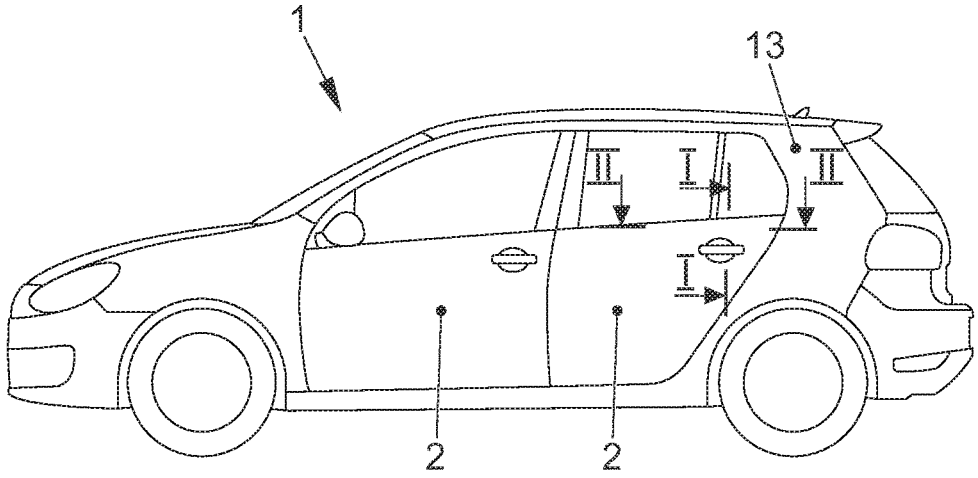
FIG. 1 shows exceptionally schematically a vehicle provided with said device in a side view.
Figure 2:
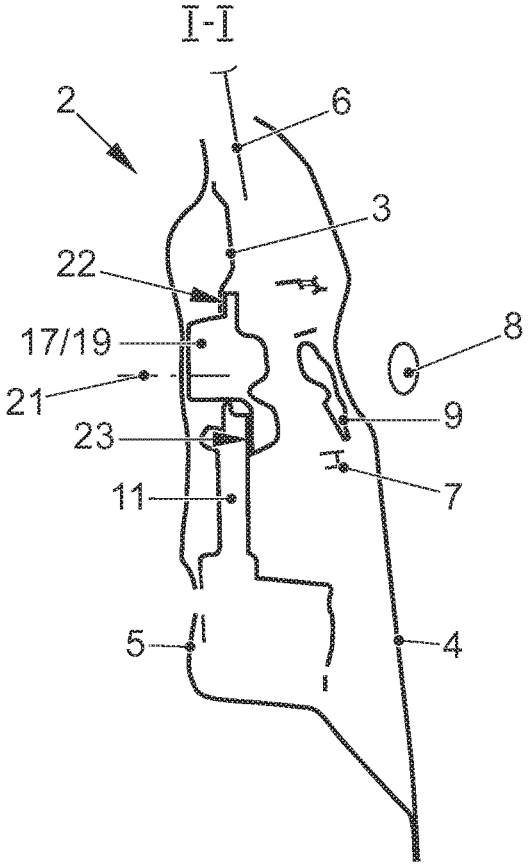
FIG. 2 shows a sectional view of a vehicle door of a vehicle according to FIG. 1 in the region of a door opening mechanism thereof (section "I-I" according to FIG. 1)

FIG. 1 shows a vehicle 1, in the present case a passenger motor vehicle, with front and rear vehicle doors 2 arranged to the side. According to FIG. 2, the vehicle doors 2 are substantially formed by a frame part 3, a door outer part 4, also denoted as the door outer panel, and a door inner part 5, also denoted as the door inner panel. Moreover, a window pane 6 is retained inside the vehicle door 2. Furthermore, the vehicle door 2 comprises a mounting clip 7 arranged on the inside of the door on the door outer part 4 for an outer door handle 8 arranged on the outside of the door on the door outer part 4. A so-called balancing mass 9 of a door opening mechanism, which is known per se, is pivotably mounted on the mounting clip 7. Said balancing mass 9 is operatively connected to the outer door handle 8 and compensates for the mass of the outer door handle 8.

Figure 3:
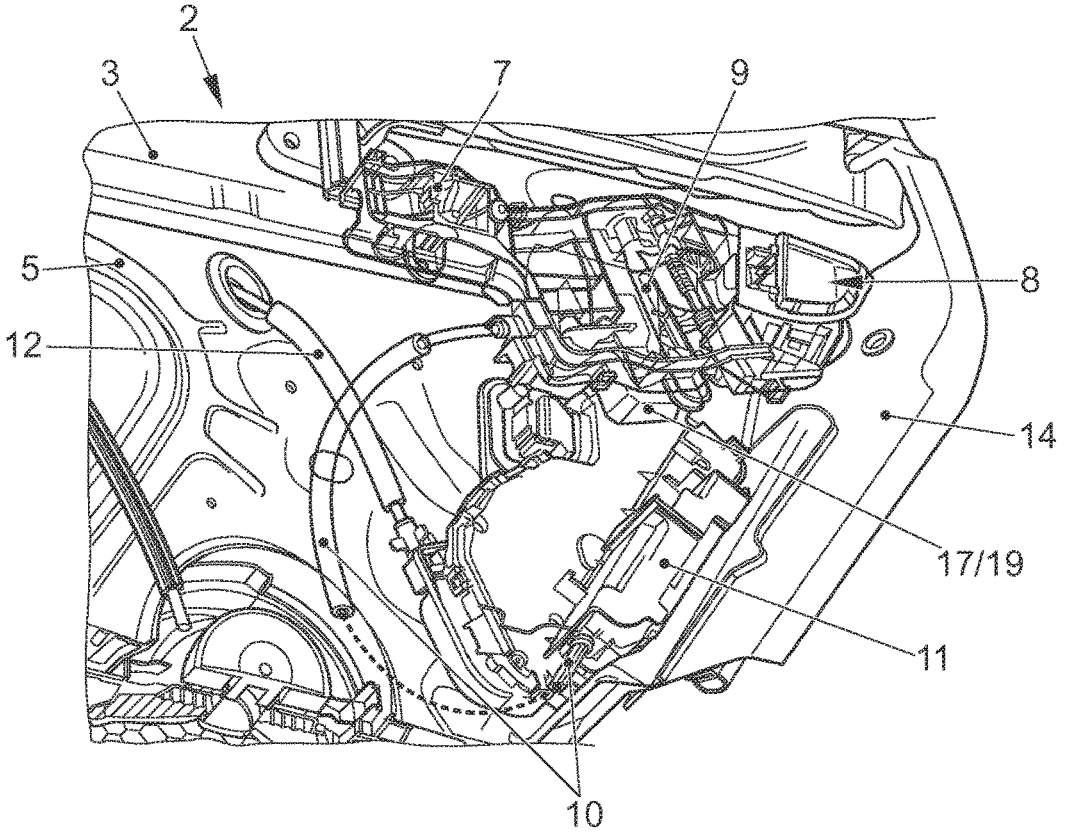
FIG. 3 shows a first perspective view of the vehicle door from the vehicle exterior in the region of said door opening mechanism.
Figure 4:
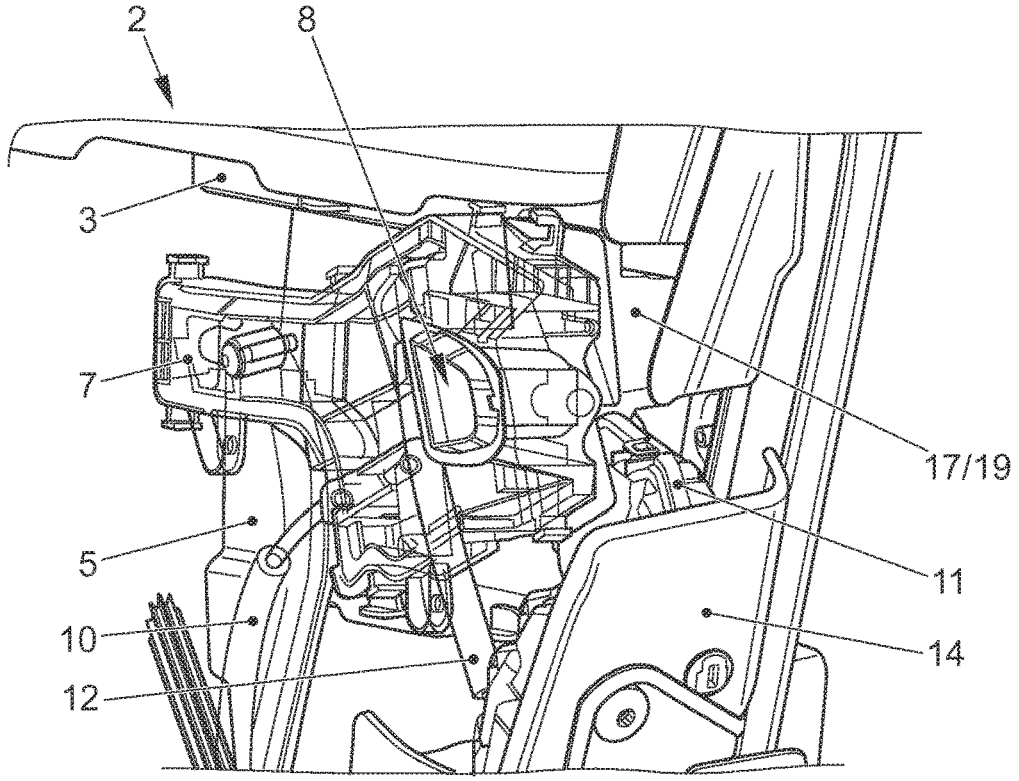
FIG. 4 shows a second perspective view of the vehicle door from the vehicle exterior in the region of said door opening mechanism.
Figure 5:
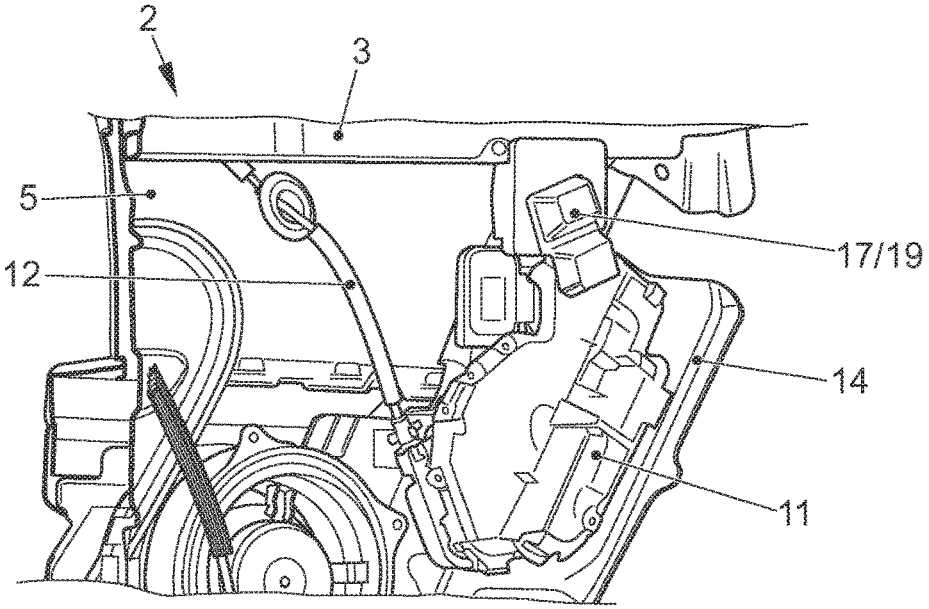
FIG. 5 shows a third perspective view of the vehicle door from the vehicle exterior in the region of said door opening mechanism, with the components of the door opening mechanism removed for the sake of improved clarity.

The balancing mass 9 is operatively connected to a door lock, which is known per se, arranged in a door lock housing 11 and not shown by way of illustration, by means of a first Bowden cable 10 visible in FIGS. 3 to 5. Moreover, a second Bowden cable 12 is shown in FIGS. 3 to 5, which in turn connects the door lock to an internal door handle, not shown by way of illustration.

According to this exemplary embodiment, which merely relates to a rear vehicle door 2 by way of example, the door lock housing 11 is secured to a front wall 14 facing a C-pillar 13 (see in particular FIG. 1) of the vehicle 1. In the known manner, the door lock, respectively a rotary latch thereof, corresponds to a closing bolt or closing bracket (not shown by way of illustration) fixedly arranged on the bodywork side, in the present case on said C-pillar 13. When the vehicle door 2 is closed, a particularly secure connection is thus produced between the vehicle door and the vehicle body. As a result of the actuation of the outer door handle 8 the balancing mass 9 is able to be transferred from a first operating position 15 (see FIGS. 6*a*, 7*a*), which as a result of the operative connection with the door lock by means of the first Bowden cable 10 corresponds to a closed position of the door lock, into a second operating position 16 (FIG. 7*b*) which corresponds to an open position of the door lock.

As may be further derived from FIGS. 2 to 5, said balancing mass 9 (FIGS. 2, 3) which is pivotably mounted on the mounting clip 7 is associated with a force introduction and locking element 17 and arranged with specific clearance relative to the balancing mass 9 which does not prevent the pivoting movement thereof for opening the door lock. The force introduction and locking element 17 is provided to come into operation merely in the case of a crash event, in particular a side crash or a comparable event, such as a corresponding crash test, in which as shown in FIG. 6*b* a barrier 18 strikes the vehicle door 2.

In the present case the force introduction and locking element 17 is formed by a pressure-resistant shaped body 19, preferably consisting of a plastic foam. However, the invention is not limited to this material but also encompasses, for example, a pressure-resistant hollow body formed from sheet metal parts or a metallic foam body (not shown by way of illustration). According to this exemplary embodiment, the force introduction and locking element 17, respectively the shaped body 19, viewed in the direction of movement 20 of the barrier 18, is at least supported and fastened against the door lock housing 11, which is fastened to the vehicle door 2, and additionally against the frame part 3 and against the door inner part 4 (see in particular FIG. 2). Merely by way of example, in the present case the force introduction and locking element 17 is firstly fixedly connected in a non-positive manner by means of, for example, a clip 21, screw element or the like, shown merely schematically, to the door inner part 5 and secondly via adhesive bonding points 22, 23 to the frame part 3 and the door lock housing 11.

Hereinafter, the invention is described further in its function with reference to FIGS. 6*a* to 7*b:*

Figure 6A:
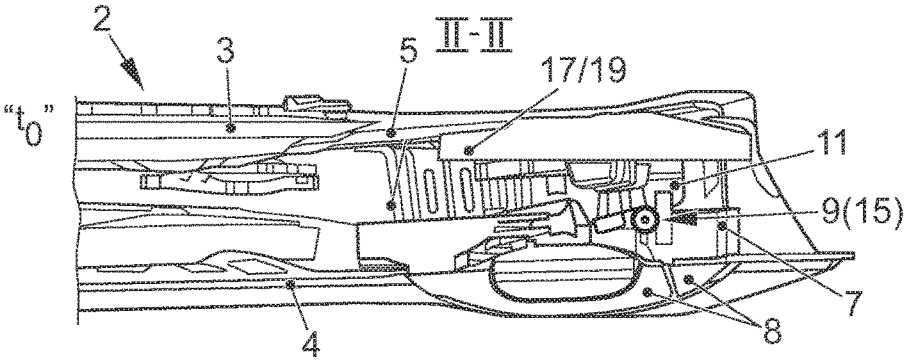
FIGS. 6*a*, 6*b* show the device according to the invention in its function (section "II-II" according to FIG. 1)
Figure 6B:
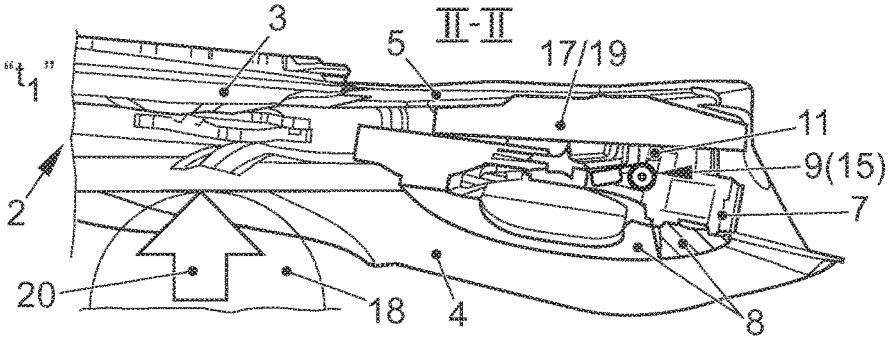
Figure 7A:
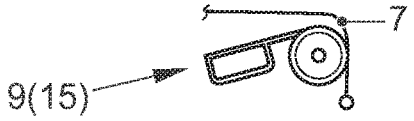
FIGS. 7*a*, 7*b* show an essential element of the door opening mechanism in two operating positions determining the function of the device.
Figure 7B:
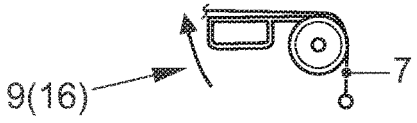

Accordingly, according to FIGS. 6*a* and 7*a* at a time "$t_0$", the vehicle door 2 is in a closed state, the outer door handle 8 is in an unactuated state and accordingly the balancing mass 9 is in its first operating position 15. Assuming, according to FIG. 6*b* a lateral impact (direction of movement 20) of a barrier 18, such as a motor vehicle, is to occur at a time "$t_1$", this impact is associated with an intrusion of the barrier 18 into the interior of the vehicle door 2 or the vehicle 1 and with a specific fold formation on the door outer part 4, in particular around the mounting clip 7. As a result, a movement of the first Bowden cable 10 and thus also of the balancing mass 9 of the opening mechanism would usually result in the balancing mass 9 being transferred into its second operating position 16 (FIG. 7*b*) and an undefined, respectively inadvertent, opening of the door lock occurring.

However, the above-described force introduction and locking element 17 acts counter thereto, said force introduction and locking element being arranged with a specific clearance relative to the balancing mass 9 in a resting position (FIG. 6*a*) but, as a result of the intrusion of the door outer part 4 together with the mounting clip 7 and the balancing mass 9, coming into contact with the balancing mass 9 (FIG. 6*b*) such that a pivoting movement of the balancing mass 9 from the first operating position 15 into the second operating position 16 is prevented and/or blocked or a pivoting movement of the balancing mass 9 which has already occurred is limited and/or reversed. This process may take place within 15 ms. By this measure, it is effectively prevented in the case of a crash event, in particular a side crash or a comparable event such as a corresponding crash test, that the first Bowden cable 10 is inadvertently actuated such that the door lock is opened and the vehicle door 2 is undesirably released.

LIST OF REFERENCE NUMERALS

1 Vehicle
2 Vehicle door
3 Frame part
4 Door outer part
5 Door inner part
6 Window pane
7 Mounting clip
8 Outer door handle
9 Balancing mass
10 First Bowden cable
11 Door lock housing
12 Second Bowden cable
13 C-pillar
14 Front wall
15 First operating position (balancing mass 9)
16 Second operating position (balancing mass 9)
17 Force introduction and locking element
18 Barrier
19 Shaped body
20 Direction of movement (barrier 18)
21 Clips
22 Adhesive bonding point
23 Adhesive bonding point

The invention claimed is:

1. A device for mechanically preventing an automatic opening of a vehicle door upon impact from an object, the device comprising:

a mounting clip fixed to an outer door part for an outer door handle and said mounting clip having a door opening mechanism with a balancing mass;

said balancing mass being adjustably supported on said mounting clip, operatively connected to the outer door handle and movable between a first operating position and a second operating position;

the vehicle door including a door inner part;

a force introduction and locking element associated with said balancing mass, said force introduction and locking element being arranged on a side of said inner door part, said force introduction and locking element being configured, in an event that the object acts on the vehicle door and as a result of a relative movement between the balancing mass and the force introduction and locking element toward one another and a contacting thereof with one another, to prevent, limit and/or reverse a movement of said balancing mass from the first operating position into the second operating position; and said force introduction and locking element, when viewed in a direction of movement of the object towards the vehicle door, being supported against a door lock housing that is fastened to the vehicle door, said force introduction and locking element connected by way of a non-positive and/or material bond to the door lock housing.

2. The device according to claim 1, wherein the vehicle door includes a frame part and wherein, viewed in the direction of movement of the object, said force introduction and locking element is additionally supported against one or both of the frame part or the door inner part of the vehicle door.

3. The device according to claim 1, wherein said force introduction and locking element is a pressure-resistant shaped body.

4. The device according to claim 3, wherein said shaped body is formed of plastic or metal.

5. The device according to claim 3, wherein said shaped body is a foam body.

6. The device according to claim 1, wherein the force introduction and locking element is connected directly to the door lock housing.

7. A vehicle, comprising a device according to claim 1.

8. The vehicle according to claim 7 configured as a motor vehicle.

* * * * *